US010975858B2

(12) United States Patent
Rüger et al.

(10) Patent No.: US 10,975,858 B2
(45) Date of Patent: Apr. 13, 2021

(54) PUMP ARRANGEMENT AND CORRESPONDING OPERATING METHOD

(71) Applicant: Dürr Systems AG, Bietigheim-Bissingen (DE)

(72) Inventors: Alexander Rüger, Murr (DE); Marcus Duschek, Ludwigsburg (DE)

(73) Assignee: Dürr Systems AG, Bietigheim-Bissingen (DE)

( * ) Notice: Subject to any disclaimer, the term of this patent is extended or adjusted under 35 U.S.C. 154(b) by 604 days.

(21) Appl. No.: 15/545,202

(22) PCT Filed: Jan. 8, 2016

(86) PCT No.: PCT/EP2016/000045
§ 371 (c)(1),
(2) Date: Jul. 20, 2017

(87) PCT Pub. No.: WO2016/116258
PCT Pub. Date: Jul. 28, 2016

(65) Prior Publication Data

US 2018/0003170 A1 Jan. 4, 2018

(30) Foreign Application Priority Data

Jan. 23, 2015 (DE) ..... 10 2015 000 869.2

(51) Int. Cl.
*F04B 49/06* (2006.01)
*F04B 49/02* (2006.01)
(Continued)

(52) U.S. Cl.
CPC ..... *F04B 49/06* (2013.01); *B05B 9/0406* (2013.01); *B05B 12/085* (2013.01);
(Continued)

(58) Field of Classification Search
CPC ..... F04B 49/00; F04B 49/06; F04B 49/065; F04B 9/137; F04B 23/04;
(Continued)

(56) References Cited

U.S. PATENT DOCUMENTS 4,682,710 A 7/1987 Turner, Jr. et al.
4,917,296 A 4/1990 Konieczynski
(Continued)

FOREIGN PATENT DOCUMENTS

CN 1176679 A 3/1998
CN 102777368 A 11/2012
(Continued)

OTHER PUBLICATIONS

International Search Report and Written Opinion for PCT/EP2016/000045 dated Mar. 18, 2016 (with English translation; 14 pages).

*Primary Examiner* — Philip E Stimpert
(74) *Attorney, Agent, or Firm* — Bejin Bieneman PLC

(57) ABSTRACT

A pump arrangement, in particular in a coating installation for the coating of components, such as a painting installation for the painting of motor vehicle body components, is provided. The pump arrangement includes a plurality of adjustable pumps for delivering a coating agent, e.g. for delivering a sealing agent for the sealing of weld seams on a motor vehicle body component. The pumps are connected in parallel such that the pumps extract the coating agent for delivery from a common inlet line and deliver said coating agent into a common outlet line. The arrangement further includes a control device for the open-loop or closed-loop control of one fluid variable at the outlet of the individual pumps, respectively, wherein the control device actuates the individual pumps individually, and/or a monitoring unit, which switches the pumps on and off non-simultaneously.

23 Claims, 5 Drawing Sheets

Figure 1:
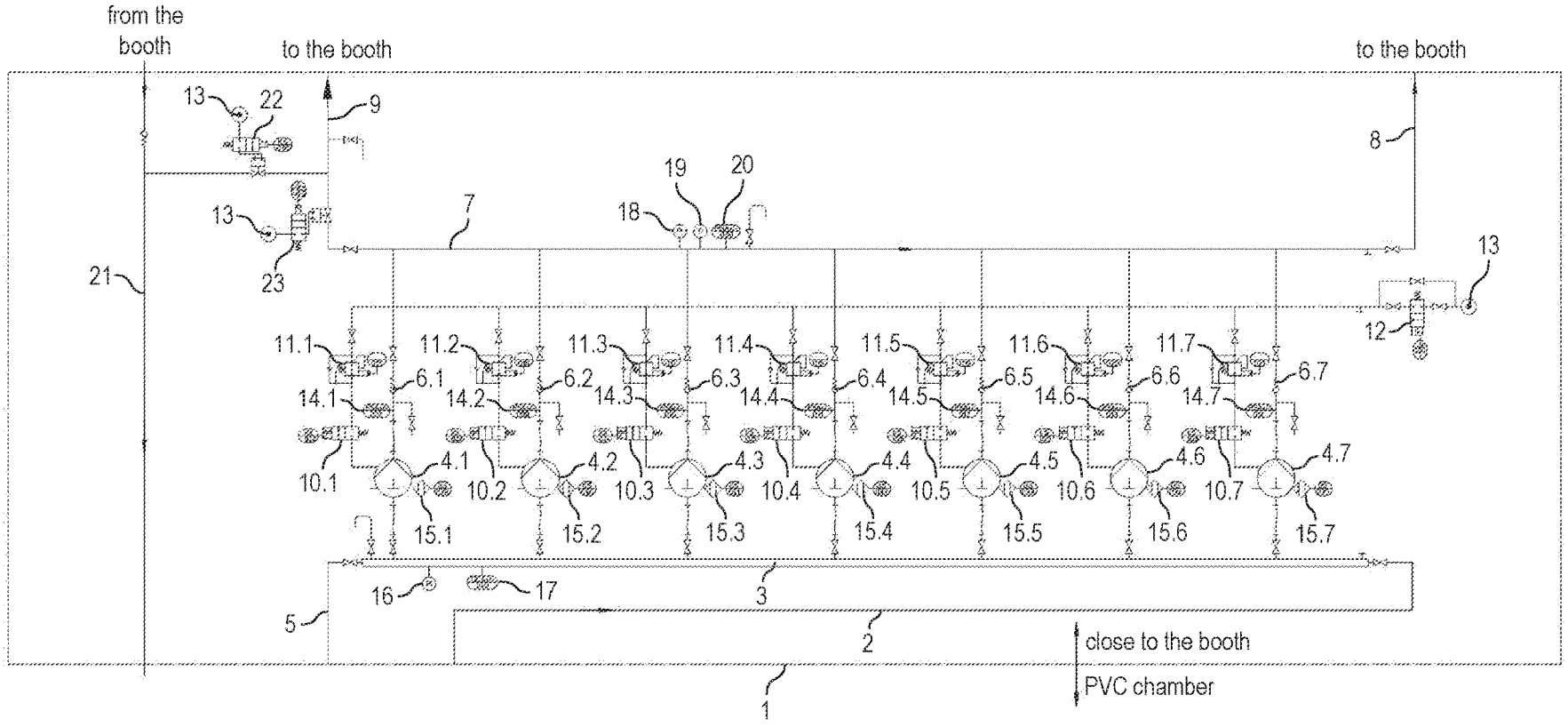

(51) Int. Cl.

| | |
|---|---|
| ***F04B 23/04*** | (2006.01) |
| ***F04B 49/08*** | (2006.01) |
| ***F04B 9/137*** | (2006.01) |
| ***F04B 23/06*** | (2006.01) |
| ***F04B 49/10*** | (2006.01) |
| ***F04B 49/22*** | (2006.01) |
| ***B05B 9/04*** | (2006.01) |
| ***B05C 11/10*** | (2006.01) |
| ***B05B 15/14*** | (2018.01) |
| ***B05B 12/08*** | (2006.01) |
| ***B05B 12/14*** | (2006.01) |
| *B05B 15/58* | (2018.01) |

(52) U.S. Cl.
CPC ..... *B05B 12/1445* (2013.01); *B05B 15/14* (2018.02); *B05C 11/1013* (2013.01); *F04B 9/137* (2013.01); *F04B 23/04* (2013.01); *F04B 23/06* (2013.01); *F04B 49/02* (2013.01); *F04B 49/065* (2013.01); *F04B 49/08* (2013.01); *F04B 49/103* (2013.01); *F04B 49/22* (2013.01); *B05B 9/0409* (2013.01); *B05B 15/58* (2018.02); *B05C 11/1044* (2013.01)

(58) Field of Classification Search
CPC .... F04B 2201/0202; F04B 9/12; F04B 9/129; F04B 9/125; F04B 23/00; F04B 49/08; F04B 49/02; F04B 49/103; F04B 49/22; F04B 23/06; B05B 9/0406; B05B 12/085; B05B 12/1445; B05C 11/1013; F04D 15/0094
USPC ..... 137/565.29, 565.33, 599.05; 417/5, 384, 417/385
See application file for complete search history.

(56) References Cited

U.S. PATENT DOCUMENTS

| | | | | |
|---|---|---|---|---|
| 5,664,938 | A * | 9/1997 | Yang | B01F 13/0827 137/114 |
| 2003/0123991 | A1* | 7/2003 | Chen | F04B 9/125 417/46 |
| 2005/0135938 | A1 | 6/2005 | Nguyen | |
| 2013/0108473 | A1* | 5/2013 | Tamminen | F04B 49/00 417/3 |

FOREIGN PATENT DOCUMENTS

| | | | |
|---|---|---|---|
| DE | 3711053 | A1 | 10/1988 |
| DE | 4025638 | C1 | 12/1991 |
| DE | 4118869 | A1 | 12/1992 |
| DE | 10134747 | A1 | 2/2003 |
| DE | 60013013 | T2 | 9/2005 |
| EP | 0413080 | A1 | 2/1991 |
| EP | 1469162 | A1 | 10/2004 |
| EP | 1481736 | A2 | 12/2004 |

* cited by examiner

PUMP ARRANGEMENT AND CORRESPONDING OPERATING METHOD

CROSS-REFERENCE TO RELATED APPLICATIONS

This application is a national stage of, and claims priority to, Patent Cooperation Treaty Application No. PCT/EP2016/000045, filed on Jan. 8, 2016, which application claims priority to German Application No. DE 10 2015 000 869.2, filed on Jan. 23, 2015, which applications are hereby incorporated herein by reference in their entireties.

BACKGROUND

The present disclosure relates to a pump arrangement, in, e.g., a coating installation for the coating of components, in particular in a painting installation for the painting of motor vehicle body components. The present disclosure further relates to an operating method for a pump arrangement of this type.

In modern painting installations for painting motor vehicle body components, seams (e.g. weld seams, flanged seams) of the motor vehicle body components for painting are normally sealed using a sealing agent (e.g. PVC: polyvinylchloride). The sealing agent can be applied using application robots, which move an applicator over the component surface along the seams. Typically, several application robots are simultaneously used in a coating booth, said robots extracting the coating agent from a common supply line. The material is supplied by several pumps, which are connected together at the inlet side and at the outlet side and pump the sealing agent into the supply line. Since the individual pumps are connected in parallel, it is necessary for the pumping speed to be set manually, so that the pumps can co-operate. In a typical coating operation, the pumps are then simultaneously switched on or off as a group.

A disadvantage of this conventional pump arrangement is that start-up of the pumps cannot be guaranteed when required, i.e. it can happen that individual pumps do not start up when an activation signal is given and then fail. In turn, this can then lead to uneven wear of the pumps, which is undesirable. Furthermore, the sealing agent can harden in the failed pump, which would destroy the pump. In addition, failure of a pump can result in errors in the process sequence. Finally the risk of individual pumps failing requires manual inspection effort.

The prior art also includes DE 600 13 013 T2, DE 101 34 747 A1, DE 41 18 869 A1, DE 40 25 638 A1 and DE 37 11 053 A1.

SUMMARY

The present disclosure provides an improved pump arrangement and a corresponding operating method for said arrangement.

A pump arrangement according to the present disclosure includes a plurality of pumps, each of which have an adjustable pumping power and serve to convey a coating agent.

The coating agent can be, for example, a sealing agent (e.g. PVC: polyvinylchloride) for sealing weld seams on a motor vehicle body component. However, it should be understood that the present disclosure is not restricted to sealing agent but is also suitable for use with other coating agents such as e.g. adhesive, paint, oil, silicone, insulating material, etc.

The present disclosure also covers many different options as regards the type of pump. The pumps can be, e.g., piston pumps, geared pumps, diaphragm pumps or positive displacement piston pumps.

In a pump arrangement according to the present disclosure, the pumps are, in some embodiments, connected in parallel at the outlet side and at the inlet side such that the pumps extract the coating agent for delivery from a common inlet line and deliver said coating agent into a common outlet line. When a plurality of pumps are connected in parallel in a pump arrangement in such a way, it is important for the operating behaviour of the individual pumps to be individually adjustable, so that the individual pumps can cooperate as effectively as possible.

In other implementations, the present disclosure also provides the option of the pumps only being interconnected at the outlet side or at the inlet side.

The present disclosure includes a monitoring unit, which enables the individual pumps to be switched on and/or off non-simultaneously. This aspect distinguishes the present disclosure from the known pump arrangements described herein, in which the pumps are always switched on and off as a group (i.e. at the same time).

This individual activation or deactivation of the individual pumps allows, for example, cyclical rotation of the activated pumps, so that the individual pumps operate in rotation. With such a rotation according to the principles of the present disclosure, the individual pumps may have a pause in their operation, which can be used for maintenance purposes or can extend the service life of the pump. Moreover, such a cyclical rotation of the activated pumps may provide that reserve capacity is available from pumps that have not been constantly inactive, as which inactivity could lead to malfunctions, for example due to hardening of coating agent in the permanently inactive pumps.

The monitoring unit therefore, in some implementations, only switches on a number (a portion of the total) of the pumps, while the remaining pumps remain switched off. The number of activated pumps can be varied as a function of the pumping capacity that is required. If, for example, a high pumping power is required, then a larger number of pumps are switched on than when only a low pumping power is required.

The monitoring unit then rotates which pumps are switched on after a predetermined operating time, so that, over time, all pumps are switched on and then switched off again in sequence. This rotation of the pumps that are switched on is, in some implementations, done cyclically, so that the ratio of operative to inoperative time is the same for all pumps. The operating time after which the activated pumps are rotated is, in some implementations, between ten minutes and four hours, for example within a range of 30 minutes to two hours.

In addition, the monitoring unit can also, in some implementations, check whether the individual pumps are actually working or not. In the pump arrangement according to the present disclosure, a pump sensor is assigned to each of the individual pumps to detect whether the respective pump is working or not. The monitoring unit can then issue a warning if a pump is switched on but is not actually working.

A variety of pump sensors may be utilized according to the principles of the present disclosure. For example, the pump sensor can register the rotation speed of the pump's drive shaft or the piston speed. Moreover, the operating status (working/not working) of the individual pumps can also be determined with a pressure measurement at the pump outlet. It should be understood that the present disclosure is not restricted to these examples for a pump sensor.

The monitoring unit according to the present disclosure also allows the pumping capacity of the whole pump arrangement to be adjusted to meet the prevailing demand. For example, the monitoring unit can switch on an additional pump, if the pumping capacity of the entire pump arrangement is insufficient. The pump arrangement according to the present disclosure therefore, in some implementations, comprises an outlet pressure sensor that is arranged in the common outlet line of the pumps and measures the outlet pressure of the entire pump arrangement. The monitoring unit then polls the outlet pressure sensor for the outlet pressure and compares this with a predetermined minimum pressure. If the outlet pressure is below the predetermined minimum pressure, the monitoring unit can switch on an additional pump, in order to increase the pumping capacity of the entire pump arrangement.

However, the undershoot of the predetermined minimum pressure in the outlet line of the pump arrangement is not necessarily attributable to an increase in the capacity demanded by the application devices. It is also possible, e.g., that there is a leak in the pipework system downstream of the pump arrangement, causing the drop in pressure. If there is such a leak, it would be preferable to switch off all the pumps, in order to limit the damage caused by the leak, rather than increase pumping capacity. The monitoring unit therefore, in some implementations, facilitates leak detection, wherein the monitoring unit signals that there is a leak if the measured outlet pressure in the common outlet line of the pump arrangement is below a predetermined minimum pressure for a predetermined minimum period.

The present disclosure provides various options in terms of the response to a detected leak, wherein said options can either be combined or executed on a phased basis. A possible response is to issue a leak warning, for example in optical or acoustic form. Another possible response is to switch off all pumps in the event of a leak, in order to minimise the damage caused by the leak. There is also the option of phased responses. For example, an optical or acoustic leak warning can initially be issued if the measured outlet pressure is below the minimum pressure for a predetermined period of time. If the failure to meet the predetermined minimum pressure then persists for longer, the monitoring units can respond to this by switching off all the pumps.

Increasing the pumping capacity of the individual pumps may come up against design limitations in terms of pumping speed for an individual pump. For example, the pistons in a piston pump should not normally exceed a certain maximum stroke speed. In an exemplary implementation of the present disclosure, a speed sensor is therefore assigned to each of the individual pumps to measure the pumping speed of the respective pump. The monitoring unit then polls the individual speed sensors, thereby determining the pumping speeds of the individual pumps.

If the monitoring unit finds that the measured pumping speed exceeds a predetermined first maximum value in at least one pump, said monitoring unit then switches on an additional pump, since the activated pumps are not sufficient to provide the pumping capacity demanded by the consumer units.

Conversely, if the measured pumping speed exceeds a second, higher maximum value, the monitoring unit can switch off the said pump. In this case, switching off individual pumps serves to avoid any damage to the respective pumps, while switching on individual pumps serves to increase the pumping capacity of the entire pump arrangement.

In some implementations, the monitoring unit can issue a warning, if the pumping speed in at least one pump exceeds a predetermined maximum value. Once again, in this situation, both responses (switching off the pump and issuing a warning) can be combined, applied individually or staggered, as already described above in relation to leaks.

The present disclosure further provides a control device to individually monitor a fluid variable (e.g. coating agent pressure) at the outlet of the individual pumps.

In an exemplary implementation, the control device is a closed-loop control device, i.e. with a feedback loop. It is also possible for the control device to be an open-loop control device, i.e. without a feedback loop.

Where the control device is, in some implementations, a closed-loop control device, which controls in each case one fluid variable (e.g. coating agent pressure) at the outlet of the individual pumps, said closed-loop control device adjusts the controlled fluid variables at the outlet of the individual pumps to a common nominal value. This individual regulation of the fluid variables (e.g. coating agent pressure) at the outlet of the individual pumps serves to significantly improve cooperation between the individual pumps. Moreover, this also prevents individual pumps from failing to start up during a switch-on procedure, as can happen with the conventional pump arrangements.

In an exemplary implementation of the present disclosure, the closed-loop control device for the individual pumps comprises in each case a measuring element, wherein said measuring element measures an actual value of the controlled fluid variable (e.g. coating agent pressure) at the outlet of the individual pumps. For example, a pressure sensor can be arranged downstream of each individual pump to measure the outlet pressure of the respective pump.

Moreover, the closed-loop control device, in some implementations, comprises in each case an actuator for the individual pumps, said actuator controlling the individual pumps with a variable control variable, in order to adjust the controlled fluid variable to the predetermined nominal value.

In a pneumatically driven pump, for example, the actuator can be a continuous valve (e.g. a proportional valve), which controls the pneumatically driven pump with an adjustable compressed air flow, in order to adjust the pumping capacity to comply with the required setting. The continuous valve (e.g. a proportional valve) can therefore act as an actuator to control the compressed air flow that serves to drive the respective pump, thereby allowing the pumping capacity to be adjusted. The use of a continuous valve (e.g. proportional valve) as an actuator to control the pneumatic pumps is advantageous, since it allows the pumping capacity of the respective pump to be continuously adjusted, in that the compressed air flow may be continuously varied. In some implementations within the scope of the present disclosure, other types of valves may be used as an actuator to govern the pneumatic pumps. It should be understood that the controller registers several measured variables (e.g. coating agent pressures at the outlet of the individual pumps) and issues several control variables (e.g. control signals for the individual proportional valves) to the actuators of the individual pumps.

The closed-loop control device according to the present disclosure, in some implementations, comprises a controller, which is connected at the inlet side with the measuring elements of the individual pumps and registers the measured actual values of the controlled fluid variables (e.g. outlet pressure) at the individual pumps from the measuring elements. The controller is connected at the outlet side with the individual actuators (e.g. proportional valves) of the individual pumps and controls these actuators with one variable control variable in each case, said control variable being dependent upon a nominal/actual variance between a predetermined nominal value and the measured actual value. The controller is therefore generally responsible for all pumps and allows individual registration of the control variables (e.g. outlet pressure) and an individual control of the individual pumps.

The present disclosure also includes a corresponding operating method corresponding with the description herein.

DRAWINGS

Figure 2:
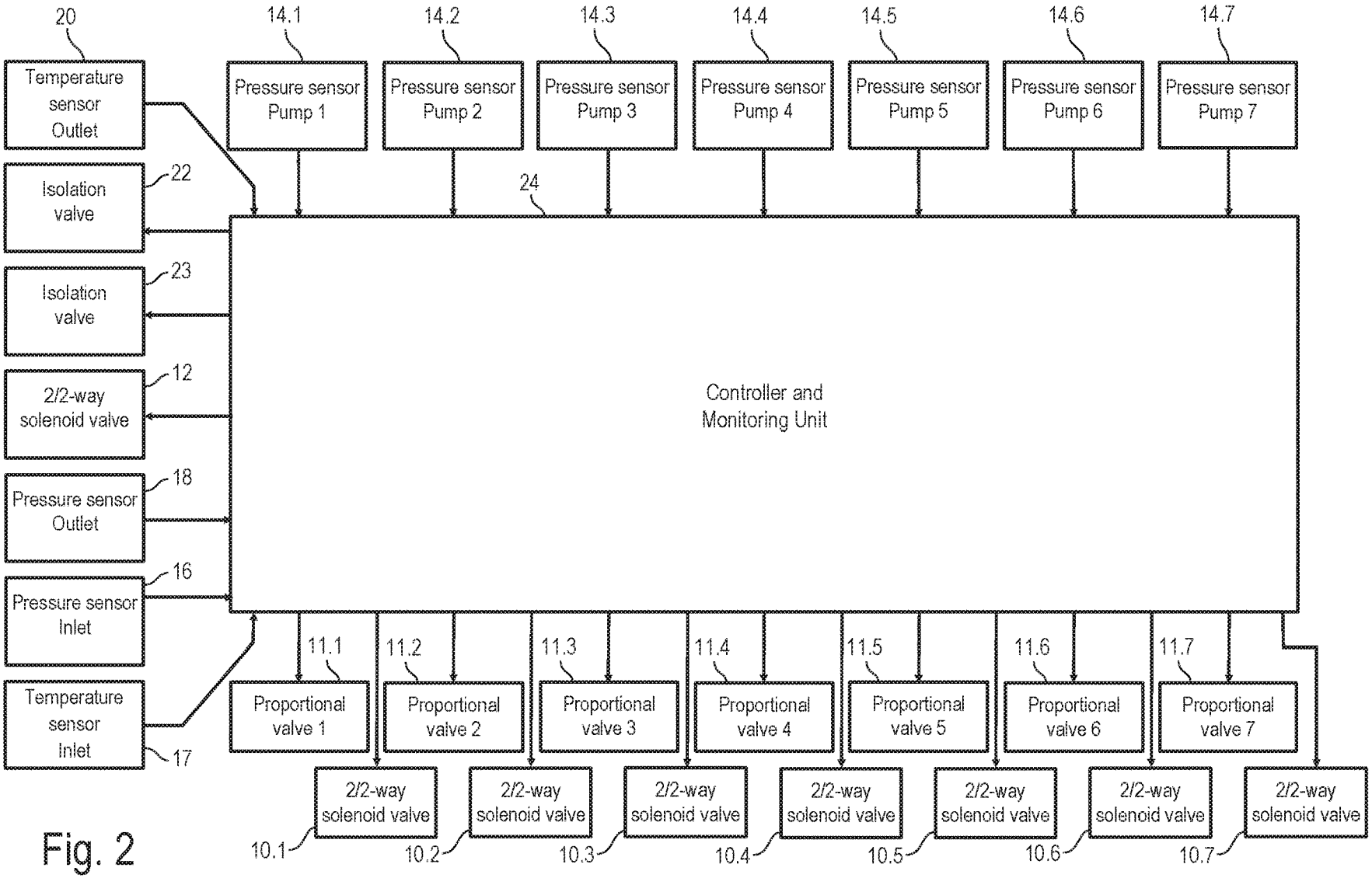
Figure 3:
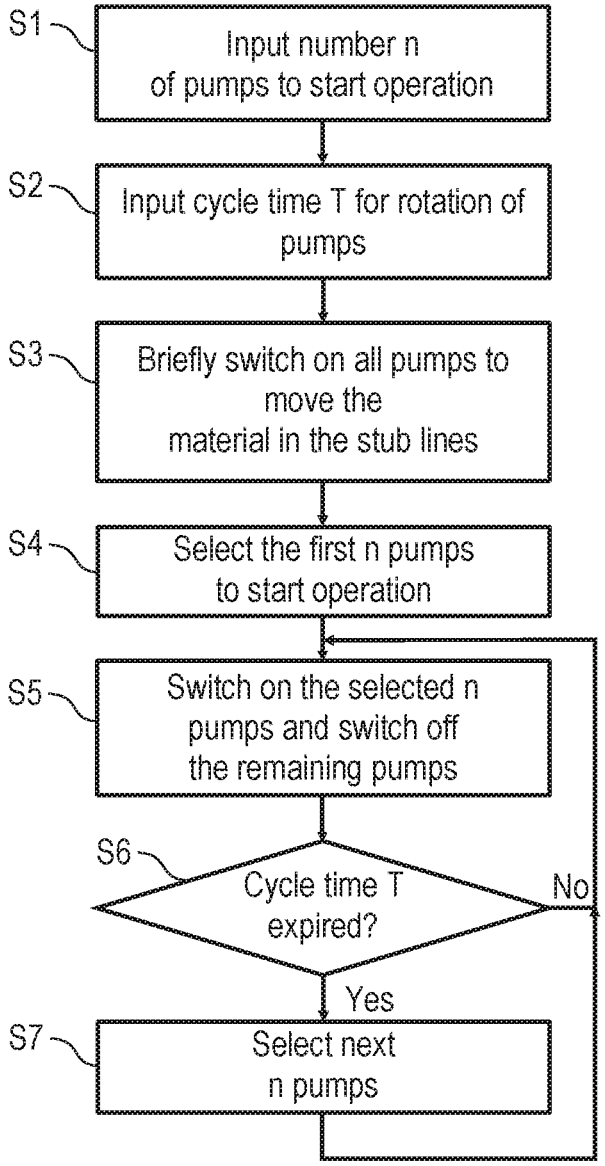
Figure 4:
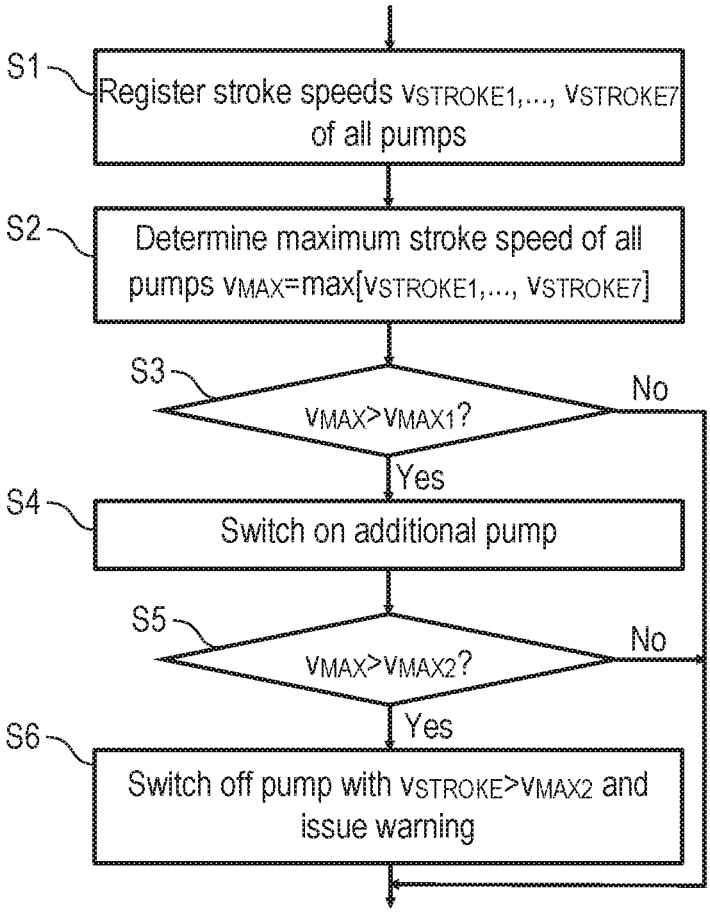
Figure 5:
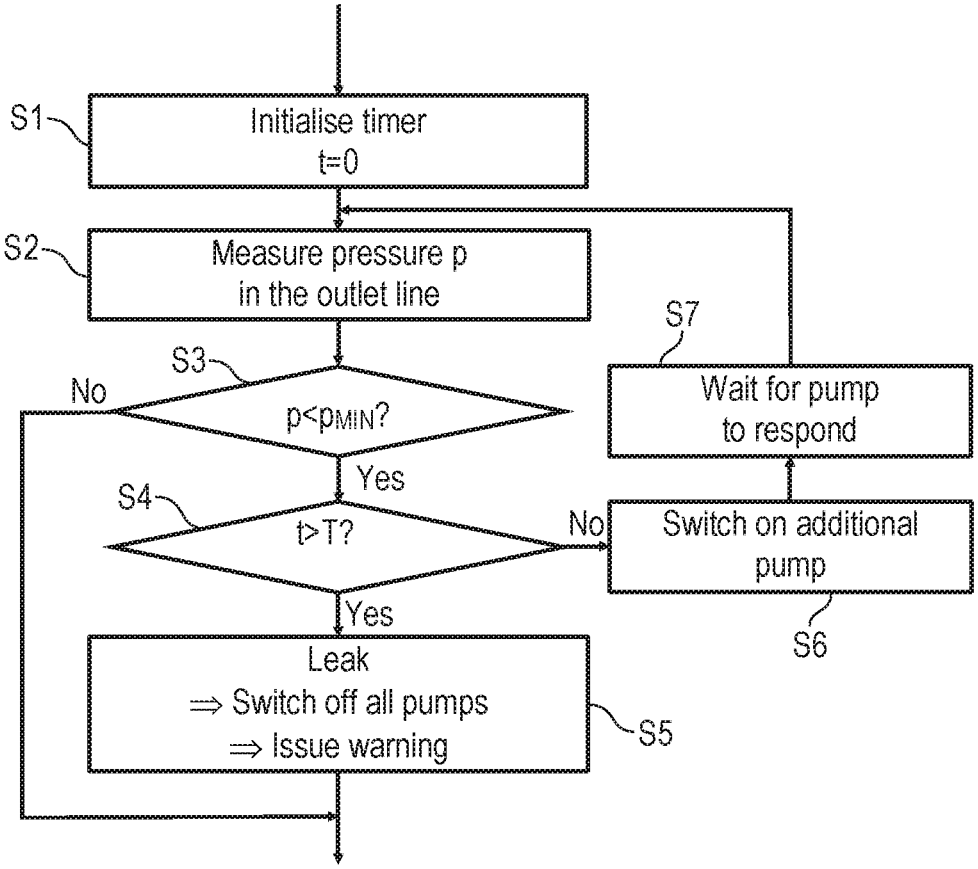

The present disclosure is further outlined in more detail herein based on the figures, together with the description of an exemplary implementations of the present disclosure. The figures show:

FIG. 1 A schematic illustration of a pump arrangement according to the present disclosure, FIG. 2 A schematic diagram of the pump arrangement from FIG. 1, FIG. 3 A flow diagram to illustrate the operating method according to the present disclosure with a cyclical rotation of the activated pumps, FIG. 4 A flow diagram to illustrate a speed control of the individual pumps, and FIG. 5 A flow diagram to illustrate leak monitoring according to the present disclosure.

DETAILED DESCRIPTION

FIG. 1 shows a pump arrangement 1, which is used in a painting installation for painting motor vehicle body components in order to pump a sealing agent (e.g. PVC: polyvinylchloride) to multiple application robots, which are not shown in the drawing, and to apply the sealing agent onto seams (e.g. flanged seams, weld seams) on the motor vehicle body components that are to be painted.

Below the broken line in FIG. 1 there is a material supply chamber, also referred to as "PVC chamber". While the region inside the broken line is situated close to the painting line or paint booth, it is outside the painting line or paint booth.

The pump arrangement 1 extracts the sealing agent from the material supply chamber via a forward line 2.

The forward line 2 opens into an inlet line 3, which supplies a plurality of parallel-connected pumps 4.1-4.7 with sealing agent.

A return line 5 further branches off from the common inlet line 3 of the pumps 4.1-4.7 in order to allow circulation of material between the material supply chamber and the pump arrangement 1.

The pumps 4.1-4.7 are respectively connected at the outlet side via a non-return valve 6.1-6.7 with a common outlet line 7, i.e. the pumps 4.1-4.7 extract the sealing agent from the common inlet line 3 and pump the sealing agent into the common outlet line 7.

Two forward lines 8, 9 run off from the common outlet line 7, said forward lines conveying the sealing agent to the individual application robots. In this way the two forward lines 8, 9 supply the application robots on opposite sides of the painting line. The forward line 8 therefore supplies the application robots on the one side of the painting line, while the forward line 9 supplies the application robots on the other side of the painting line.

The individual pumps 4.1-4.7 are respectively pneumatically driven. For this purpose, the pumps 4.1-4.7 are respectively connected, via a 2/2-way solenoid valve 10.1-10.7 and a proportional valve 11.1-11.7, to a common 2/2-way solenoid valve 12 with a compressed air supply 13.

The 2/2-way solenoid valve 12 is able to either enable or disable the compressed air for all the pumps 4.1-4.7. This allows common switching on and/or off of the pumps 4.1-4.7 by the 2/2-way solenoid valve 12.

The individual pumps 4.1-4.7 can also be switched on and/or off individually, by opening or closing the respective 2/2-way solenoid valve 10.1-10.7.

Furthermore, the pumping capacity of the individual pumps 4.1-4.7 can also be individually adjusted, namely via appropriate control of the individual proportional valves 11.1-11.7.

A pressure sensor 14.1-14.7 is respectively arranged downstream of each of the pumps 4.1-4.7, the individual pressure sensors 14.1-14.7 measuring in each case the outlet pressure of the individual pumps 4.1-4.7.

An initiator 15.1-15.7 is further arranged in each of the pumps 4.1-4.7 to monitor the stroke of the individual pumps 4.1-4.7. Firstly, the initiators 15.1-15.7 allow monitoring of the pumping speeds of the individual pumps 4.1-4.7, as will described in detail below. Secondly, the initiators 4.1-4.7 also allow checking of whether the individual pumps 4.1-4.7 are working.

In some implementations, a pressure sensor 16 is assigned to the common inlet line 3 of the pumps 4.1-4.7 to measure the pressure in the inlet line 3.

Moreover, the common inlet line 3 of the pumps 4.1-4.7 further comprises a temperature sensor 17, which measures the temperature of the sealing agent in the inlet line 3.

A pressure sensor 18 and a temperature sensor 19 are also arranged in the outlet line 7 to measure the pressure and temperature respectively of the sealing agent in the outlet line 7. In addition, a further pressure sensor 20 is situated in the outlet line 7, said pressure sensor delivering an electrical pressure signal to a control, as described in detail below.

Finally, the pump arrangement 1 also comprises a return line 21 and two pneumatically driven isolation valves 22, 23. The isolation valve 22 is closed in production mode and opened in circulation mode. Conversely, the isolation valve 23 is opened in production mode and closed in circulation mode. In this case, production mode is the operating condition, in which the connected application robots demand sealing agent, i.e. in normal coating operation. Circulation mode, on the other hand, is an operating condition, in which the connected application robots do not demand any sealing agent, for example during overnight or weekend shutdown or during maintenance outages.

FIG. 2 shows a schematic view of the pump arrangement 1 described above and illustrated in FIG. 1. Further to the illustration in FIG. 1, this also shows a control device 24, which includes a closed-loop control device and a monitoring unit.

At the inlet side, the control device 24 is connected to the pressure sensors 14.1-14.2, to measure the pressure upstream behind the individual pumps 4.1-4.7, which allows control of the outlet pressure of the individual pumps 4.1-4.7, as described in detail below.

In addition, the control device 24 is connected at the inlet side with the temperature sensor 17, the pressure sensor 16, the pressure sensor 18 and the temperature sensor 20, in order to be able to take account of the readings of these sensors in the control of the pump arrangement 1.

At the outlet side, the control device 24 is connected to the two isolation valves 22, 23 and to the 2/2-way solenoid valve 12, to control the operation of the pump arrangement 1, as described in further detail herein.

The control device 24 is further connected at the outlet side with the proportional valves 11.1-11.7, in order to control the individual pumps 4.1-4.7 in keeping with the control setting.

Finally, the control device 24 is also connected at the outlet side with the 2/2-way solenoid valves 10.1-10.7 of the individual pumps 4.1-4.7, in order to be able to switch the individual pumps 4.1-4.7 on or off individually, as will also be described in detail below.

As mentioned above, the control device 24 contains a controller to control the outlet pressure of the individual pumps 4.1-4.7. To do this, the control device 24 respectively registers actual values of the individual pumps 4.1-4.7 via the pressure sensors 14.1-14.2 and compares the measured actual values with a predetermined, uniform nominal pressure value. From this, the control device 24 calculates a nominal/actual variance between the nominal value and the actual value of the individual pumps 4.1-4.7. As a function of this nominal/actual variance, the control device 24 then controls the individual proportional valves 11.1-11.7 individually with a control signal, in order to adjust the actual outlet pressure value of the individual pumps 4.1-4.7 individually for each of the pumps 4.1-4.7 to the nominal value.

Moreover, the control device 24 is able to switch the individual pumps 4.1-4.7 on or off individually. This can be done using the operating method illustrated in the form of a flow diagram in FIG. 3, in order to switch on the individual pumps 4.1-4.7 on a cyclical basis, as described below.

In a first step S1, the operator of the pump arrangement 1 inputs a number n of pumps to start operation. The number n of pumps required depends upon the capacity demanded by the connected application robots.

In a step S2, the operator of the pump arrangement 1 then inputs a cycle time T for rotating the pumps 4.1-4.7 that are switched on.

In a step S3, all pumps 4.1-4.7 are then briefly switched on, in order to move the coating material in the stub lines to the individual application robots.

In a step S4, the first n pumps to start operation are then selected. For example, for a number n=4, pumps 4.1-4.4 can be selected.

In a subsequent step S5, the selected n pumps are then switched on, while the remaining pumps remain switched off. For example, for a number n=4, pumps 4.1-4.4 can be switched on, while pumps 4.5-4.7 remain switched off.

In a step S6, continuous monitoring takes place to check whether the predetermined cycle time T has elapsed.

If it has, the next n pumps are then selected in a step S7. In the example outlined above, the pumps 4.2-4.5 can then be selected for subsequent activation, while pumps 4.1 and 4.6, 4.7 remain switched off.

Finally one passes to step S5, in which the selected pumps are then switched on or switched off.

In this manner all pumps 4.1-4.7 are switched on in a cyclical sequence, wherein a number of the pumps 4.1-4.7 always remain switched off, unless the capacity demanded requires that all pumps 4.1-4.7 be switched on. This cyclical rotation of the activated pumps is advantageous, since it ensures even wear of the pumps 4.1-4.7.

Moreover, the control device 24 allows an operating method, which is illustrated in the form of a simplified flow diagram in FIG. 4 and is described below.

In a step S1, the stroke speed $v_{STROKE1}, \ldots, v_{STROKE7}$ of all pumps 4.1-4.7 is initially measured. This measurement can be done, for example, with the initiators 15.1-15.7.

In a further step S2, the maximum stroke speed $v_{MAX}$ of all pumps 4.1-4.7 is then measured.

In a step S3, it is then checked whether this maximum stroke speed $v_{MAX}$ exceeds a predetermined maximum value $v_{MAX1}$.

If it does, then, in a step S4, an additional pump 4.1-4.7 is activated, in order to reduce the stroke speed $v_{MAX}$ to below the predetermined maximum value $v_{MAX1}$.

In a step S5, it is then checked whether the maximum pumping speed $v_{MAX}$ exceeds a predetermined second maximum value $v_{MAX2}$.

If it does, then, in a step S6, those pumps in which the stroke speed $v_{MAX}$ exceeds the predetermined maximum value $v_{MAX2}$ are switched off and a warning is issued.

This speed monitoring and optional switching on of additional pumps should prevent the pumping speed going above the predetermined limits.

Finally, the control device 24 allows a further operating method, which is schematically illustrated in the form of a flow diagram in FIG. 5 and allows leak detection.

In a step S1, a timer t=0 is initialised.

In a step S2, a pressure p is then measured in the outlet line 7, which can be done with the pressure sensor 20.

In a step S3, the measured pressure p is then compared with a predetermined minimum value $p_{MIN}$.

If the measured pressure p is below the predetermined minimum pressure $p_{MIN}$, then, in a step S4, it is checked whether the actual value t of the time exceeds a predetermined time value T. If it does not, the control device 24 attempts to increase the excessively low pressure, in that an additional pump 4.1-4.7 is switched on in a step S6. In a step S7, the pump response is then awaited and, upon this response, the pressure p is then re-measured in a step S2.

If the pressure check reveals that the measured pressure p is above the minimum pressure $p_{MIN}$ after switching on of an additional pump, then no further action is required.

On the other hand, if the pressure check reveals that the pressure is still below the predetermined minimum pressure $p_{MIN}$, then, in a step S4, it is checked whether the excessively low pressure has already persisted for the predetermined time period T.

If it has, this indicates the presence of a leak. In a step S5, all pumps 4.1-4.7 are switched off, as required, and a leak warning is issued.

The present disclosure is not limited to the exemplary implementations described above. Rather, there are a large number of possible variants and adaptations that similarly make use of the principles of the present disclosure.

The invention claimed is:

1. A pump arrangement comprising:

a common outlet line;

an outlet pressure sensor in the common outlet line;

a plurality of pumps configured to deliver a coating agent, each of the plurality of pumps having an adjustable pumping power, the plurality of pumps being fluidly connected in parallel to at least one of the common outlet line and a common inlet line;

a pump sensor at each of the plurality of pumps, the pump sensors configured to detect whether the respective one of the plurality of pumps is working; and a closed-loop control device configured to actuate each of the plurality of pumps individually, the control device configured to adjust a fluid variable at an outlet of each of the plurality of pumps to a respective nominal value;

wherein the closed-loop control device comprises an actuator for each of the plurality of pumps, respectively, the actuators respectively configured to operate the respective one of the plurality of pumps with a variable control variable to adjust the fluid variable to the respective nominal value;

wherein the control device is configured to switch each of the plurality of pumps on and off non-simultaneously;

wherein the control device is configured to determine whether the respective ones of the plurality of pumps that are switched on are working and issues a warning signal if any one or more of the respective ones of the plurality of pumps that are switched on is not actually working;

wherein the control device is configured to query the outlet pressure sensor for a pressure value in the common outlet line, and is further configured to switch on an additional one of the plurality of pumps if the pressure value is below a predetermined minimum pressure; and the plurality of pumps are pneumatically driven, and the actuators are each a continuous valve configured to control each of the plurality of pneumatically driven pumps with an adjustable compressed air flow.

2. The pump arrangement according to claim 1, wherein the fluid variable is one of a coating agent pressure and a fluid flow at each of the plurality of pumps, respectively.

3. The pump arrangement according to claim 2, wherein the closed-loop control device is configured to adjust the fluid variable for each of the plurality of pumps to a common nominal value, respectively.

4. The pump arrangement according to claim 3, wherein the closed-loop control device includes a measuring element for each of the plurality of pumps, respectively, the measuring element configured to determine a value of the fluid variable at the outlet of the each of the plurality of pumps, respectively.

5. The pump arrangement according to claim 4, wherein the measuring element for each of the plurality of pumps is a pressure sensor configured to determine the coating agent pressure at the outlet of the respective one of the plurality of pumps.

6. The pump arrangement according to claim 1, the closed-loop control device comprises a controller, the controller being connected to the actuators of each of the plurality of pumps and respectively controlling the actuators.

7. The pump arrangement according to claim 4, wherein the closed-loop control device comprises a controller, the controller being connected with the measuring elements of each of the plurality of pumps and registering the measured values of the fluid variable at each of the plurality of pumps.

8. The pump arrangement according to claim 1, wherein, if the pressure value is below the predetermined minimum pressure for a predetermined minimum time period, the control device is configured to switch off all of the plurality of pumps.

9. The pump arrangement according to claim 1, further comprising a speed sensor for each of the plurality of pumps, wherein the control device is configured to query the speed sensors, respectively, and thereby determines the pumping speeds of each of the plurality of pumps, respectively, the control device activating an additional one of the plurality of pumps if at least one of the measured pumping speeds exceeds a predetermined first maximum value, the control device switching off the respective ones of the plurality of pumps for which the pumping speed exceeds a predetermined second maximum value, the second maximum value being greater than the first maximum value.

10. A method for operation of a pump arrangement with a plurality of pumps, which are connected in parallel at at least one of an inlet side and an outlet side, the method comprising:

determining a fluid variable at an outlet of each of the plurality of pumps;

controlling each of the plurality of pumps toward a respective nominal value of the fluid variable;

respectively switching on and/or off the plurality pumps non-simultaneously;

switching on a first group of the plurality of pumps and switching off a remaining group of the plurality of pumps;

operating the first group for a predetermined operating time;

rotating the ones of the plurality of pumps in the first group;

comparing an operating variable of the each of the plurality of pumps to a first maximum value and a second maximum value, the second maximum value being greater than the first maximum value;

switching on an additional one of the plurality of pumps, if the operating variable exceeds the first maximum value in any of the plurality of pumps; and switching off any of the plurality of pumps in which the operating variable exceeds the second maximum value.

11. The method of claim 10, further comprising:

initially switching on of all of the plurality of pumps for an activation period in the range of 1 s-10 s.

12. The method of claim 10, wherein each of the plurality of pumps are piston pumps, configured to operate with a variable piston stroke speed, and the operating variable is a piston stroke speed.

13. The method according to claim 10, further comprising:

comparing a coating agent pressure in a common outlet line to a predetermined minimum value;

switching on an additional one of the plurality of pumps if the coating agent pressure in the common outlet line is below the predetermined minimum value; and if the coating agent pressure in the common outlet line is below the predetermined minimum value for a predetermined time period, switching off all of the plurality of pumps and issuing a leak warning.

14. A pump arrangement comprising:

a plurality of pumps configured to deliver a coating agent, each of the plurality of pumps having an adjustable pumping power, the plurality of pumps being fluidly connected in parallel to at least one of a common outlet line and a common inlet line;

the common outlet line and an outlet pressure sensor in the common outlet line;

a closed-loop control device configured to actuate each of the plurality of pumps individually, the control device configured to adjust a fluid variable at an outlet of each of the plurality of pumps to a respective nominal value; and a pump sensor at each of the plurality of pumps, the pump sensors configured to detect whether the respective one of the plurality of pumps is working;

wherein the control device is configured to switch each of the plurality of pumps on and off non-simultaneously;

the control device is configured to determine whether the respective ones of the plurality of pumps that are switched on are working and issues a warning signal if any one or more of the respective ones of the plurality of pumps that are switched on is not actually working; and the control device is configured to query the outlet pressure sensor for a pressure value in the common outlet line, and is further configured to switch on an additional one of the pumps if the pressure value is below a predetermined minimum pressure.

15. A pump arrangement comprising:

a plurality of pumps configured to deliver a coating agent, each of the plurality of pumps having an adjustable pumping power, the plurality of pumps being fluidly connected in parallel to at least one of a common outlet line and a common inlet line;

a closed-loop control device configured to actuate each of the plurality of pumps individually, the control device configured to adjust a fluid variable at an outlet of each of the plurality of pumps to a respective nominal value;

a pump sensor at each of the plurality of pumps, the pump sensors configured to detect whether the respective one of the plurality of pumps is working; and a speed sensor for each of the plurality of pumps;

wherein the control device is configured to switch each of the plurality of pumps on and off non-simultaneously;

the control device is configured to determine whether the respective ones of the plurality of pumps that are switched on are working and issues a warning signal if any one or more of the respective ones of the plurality of pumps that are switched on is not actually working; and the control device is configured to query the speed sensors, respectively, and thereby determines the pumping speeds of each of the plurality of pumps, respectively, the control device activating an additional pump if at least one of the measured pumping speeds exceeds a predetermined first maximum value, and the control device switching off the respective ones of the plurality of pumps for which the pumping speed exceeds a predetermined second maximum value, the second maximum value being greater than the first maximum value.

16. A method for operation of a pump arrangement with a plurality of pumps, which are connected in parallel at at least one of an inlet side and an outlet side, the method comprising:

determining a fluid variable at an outlet of each of the plurality of pumps;

controlling each of the plurality of pumps toward a nominal value of the fluid variable;

respectively switching on and/or off the plurality pumps non-simultaneously;

comparing an operating variable of the each of the plurality of pumps to a first maximum value and a second maximum value, the second maximum value being greater than the first maximum value;

switching on an additional one of the plurality of pumps, if the operating variable exceeds the first maximum value in any of the plurality of pumps; and switching off any of the plurality of pumps in which the operating variable exceeds the second maximum value.

17. A method for operation of a pump arrangement with a plurality of pumps, which are connected in parallel at at least one of an inlet side and an outlet side, the method comprising:

determining a fluid variable at an outlet of each of the plurality of pumps;

controlling each of the plurality of pumps toward a respective nominal value, of the fluid variable; and respectively switching on and/or off the plurality pumps non-simultaneously;

comparing a coating agent pressure in a common outlet line to a predetermined minimum value;

switching on an additional one of the pumps if the coating agent pressure in the common outlet line is below the predetermined minimum value; and if the coating agent pressure in the common outlet line is below the predetermined minimum value for a predetermined time period, switching off all the pumps and issuing a leak warning.

18. A pump arrangement comprising:

a plurality of pumps configured to deliver a coating agent, each of the plurality of pumps having an adjustable pumping power, the plurality of pumps being fluidly connected in parallel to at least one of a common outlet line and a common inlet line; and a closed-loop control device configured to actuate each of the plurality of pumps individually, the control device configured to adjust a fluid variable at an outlet of each of the plurality of pumps to a respective nominal value;

wherein the closed-loop control device comprises an actuator for each of the plurality of pumps, respectively, the actuators respectively configured to operate the respective on of the plurality of pumps with a variable control variable to adjust the fluid variable to the respective nominal value; and the plurality of pumps are pneumatically driven, and the actuators are each a continuous valve configured to control each of the plurality of pneumatically driven pumps with an adjustable compressed air flow;

wherein the control device is configured to switch each of the plurality of pumps on and off non-simultaneously;

a pump sensor at each of the plurality of pumps, the pump sensors configured to detect whether the respective one of the plurality of pumps is working, wherein the control device is configured to determine whether the respective ones of the plurality of pumps that are switched on are working and issues a warning signal if any one or more of the respective ones of the plurality of pumps that are switched on is not actually working;

wherein the common outlet line has an outlet pressure sensor in the common outlet line, and;

wherein the control device is configured to query the outlet pressure sensor for a pressure value in the common outlet line, and is further configured to switch on an additional one of the plurality of pumps if the pressure value is below a predetermined minimum pressure.

19. The pump arrangement according to claim 18, wherein, if the pressure value is below the predetermined minimum pressure for a predetermined minimum time period, the control device is configured to switch off all of the plurality of pumps.

20. A pump arrangement comprising:

a plurality of pumps configured to deliver a coating agent, each of the plurality of pumps having an adjustable pumping power, the plurality of pumps being fluidly connected in parallel to at least one of a common outlet line and a common inlet line; and a closed-loop control device configured to actuate each of the plurality of pumps individually, the control device configured to adjust a fluid variable at an outlet of each of the plurality of pumps to a respective nominal value;

wherein the closed-loop control device comprises an actuator for each of the plurality of pumps, respectively, the actuators respectively configured to operate the respective on of the plurality of pumps with a variable control variable to adjust the fluid variable to the respective nominal value; and the plurality of pumps are pneumatically driven, and the actuators are each a continuous valve configured to control each of the plurality of pneumatically driven pumps with an adjustable compressed air flow;

wherein the control device is configured to switch each of the plurality of pumps on and off non-simultaneously;

a pump sensor at each of the plurality of pumps, the pump sensors configured to detect whether the respective one of the plurality of pumps is working, wherein the control device is configured to determine whether the respective ones of the plurality of pumps that are switched on are working and issues a warning signal if any one or more of the respective ones of the plurality of pumps that are switched on is not actually working;

a speed sensor for each of the plurality of pumps, wherein the control device is configured to query the speed sensors, respectively, and thereby determines the pumping speeds of each of the plurality of pumps, respectively, the control device activating an additional one of the plurality of pumps if at least one of the measured pumping speeds exceeds a predetermined first maximum value, the control device switching off the respective ones of the plurality of pumps for which the pumping speed exceeds a predetermined second maximum value, the second maximum value being greater than the first maximum value.

21. A method for operation of a pump arrangement with a plurality of pumps, which are connected in parallel at at least one of an inlet side and an outlet side, the method comprising:

determining a fluid variable at an outlet of each of the plurality of pumps;

controlling each of the plurality of pumps toward a respective nominal value of the fluid variable;

respectively switching on and/or off the plurality pumps non-simultaneously;

switching on a first group of the plurality of pumps and switching off a remaining group of the plurality of pumps;

operating the first group for a predetermined operating time; and rotating the ones of the plurality of pumps in the first group, comparing an operating variable of the each of the plurality of pumps to a first maximum value and a second maximum value, the second maximum value being greater than the first maximum value;

switching on an additional one of the plurality of pumps, if the operating variable exceeds the first maximum value in any of the plurality of pumps; and switching off any of the plurality of pumps in which the operating variable exceeds the second maximum value.

22. The method of claim 21, wherein each of the plurality of pumps are piston pumps, configured to operate with a variable piston stroke speed, and the operating variable is a piston stroke speed.

23. A method for operation of a pump arrangement with a plurality of pumps, which are connected in parallel at at least one of an inlet side and an outlet side, the method comprising:

determining a fluid variable at an outlet of each of the plurality of pumps;

controlling each of the plurality of pumps toward a respective nominal value of the fluid variable;

respectively switching on and/or off of the plurality pumps non-simultaneously;

switching on a first group of the plurality of pumps and switching off a remaining group of the plurality of pumps;

operating the first group for a predetermined operating time; and rotating the ones of the plurality of pumps in the first group, comparing a coating agent pressure in a common outlet line to a predetermined minimum value;

switching on an additional one of the plurality of pumps if the coating agent pressure in the common outlet line is below the predetermined minimum value; and if the coating agent pressure in the common outlet line is below the predetermined minimum value for a predetermined time period, switching off all of the plurality of pumps and issuing a leak warning.

* * * * *